United States Patent [19]

Jaffe et al.

[11] 4,065,739

[45] Dec. 27, 1977

[54] REVERSIBLE DIRECTION SOLENOID ASSEMBLY

[75] Inventors: Wolfgang Jaffe, Roselle Park; Wesley Robinson Peterson, Bound Brook, both of N.J.

[73] Assignee: The Singer Company, New York, N.Y.

[21] Appl. No.: 691,180

[22] Filed: May 28, 1976

[51] Int. Cl.[2] ..... H01F 7/16

[52] U.S. Cl. ..... 335/234; 29/607; 335/261

[58] Field of Search ..... 29/607, 608, 609; 322/47; 335/234, 261, 262, 270, 278, 281; 336/110

[56] References Cited

U.S. PATENT DOCUMENTS

| | | | |
|---|---|---|---|
| 2,869,088 | 1/1959 | Cushman | 336/110 |
| 3,262,027 | 7/1966 | Zaleske et al. | 335/261 |
| 3,504,315 | 3/1970 | Stanwell | 335/234 |
| 3,521,149 | 7/1970 | Roesel | 322/47 |
| 3,728,786 | 4/1973 | Lucas et al. | 29/608 X |

*Primary Examiner*—A. D. Pellinen

*Attorney, Agent, or Firm*—Edward L. Bell; Robert E. Smith; William V. Ebs

[57] ABSTRACT

A polarized reversible direction solenoid having a rectangular sheet of flexible permanently magnetized material wrapped around the armature. This magnetized flexible sheet permits the construction of very small reversible solenoids at a reasonable cost.

4 Claims, 4 Drawing Figures

REVERSIBLE DIRECTION SOLENOID ASSEMBLY

BACKGROUND OF THE INVENTION

Hitherto, reversible solenoids were constructed in one of three ways: those having (1) solid round armature magnetized radially, (2) a hollow armature magnetized radially or (3) a solid armature over which a magnetized annular ring is placed. Each of these methods has its own distinct problems which become amplified as the size of the solenoids is reduced. With respect to the first method, it is very difficult to magnetize a solid round rod radially; as to the second and third methods, the size of the solenoid is limited to the size of the magnetizing coil which must be inserted in the bore of the armature or annular ring.

SUMMARY OF THE INVENTION

The object of this invention is to provide a very small reversible direction solenoid at a reasonable cost. This objective is achieved by first magnetizing a flexible sheet of magnetizable material through its thickness while it is kept in a flat substantially planar form, and then wrapping this sheet around a core and attaching it thereto. When manufactured in this manner, the size limitations on solenoids as previously mentioned no longer exist and, consequently, there is no need for special equipment for the magnetization process.

With the above and additional objects and advantages in view as will hereinafter appear, this invention will be described with reference to the accompanying drawing of a preferred embodiment.

DESCRIPTION OF THE PREFERRED EMBODIMENT

Figure 2:
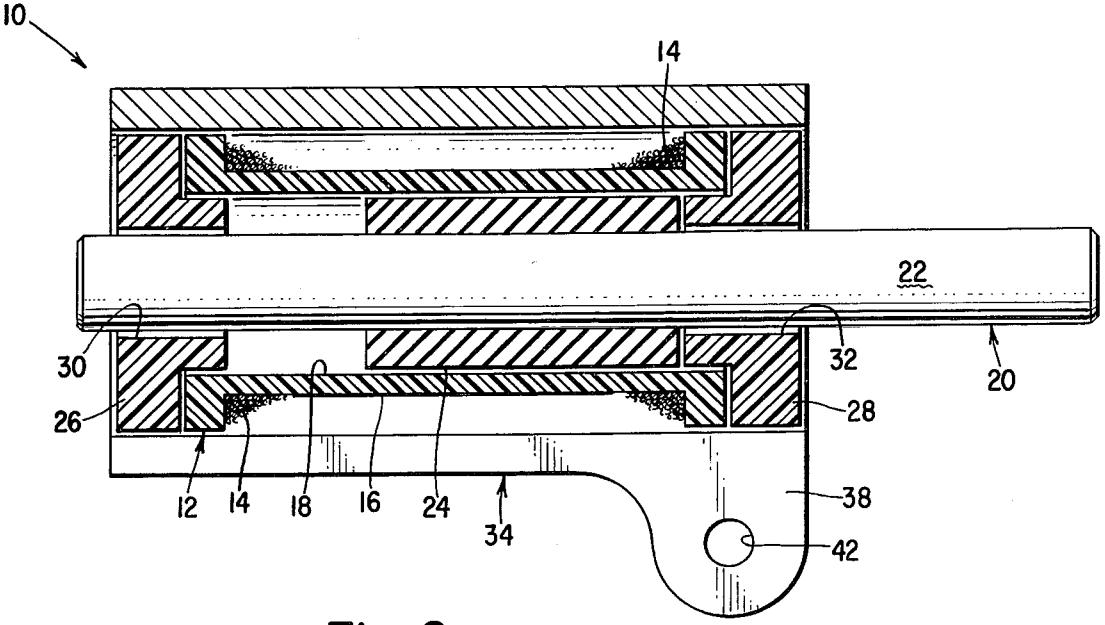
FIG. 2 is a cross-sectional view of the solenoid taken substantially along line 2—2 of FIG. 1.
Figure 1:
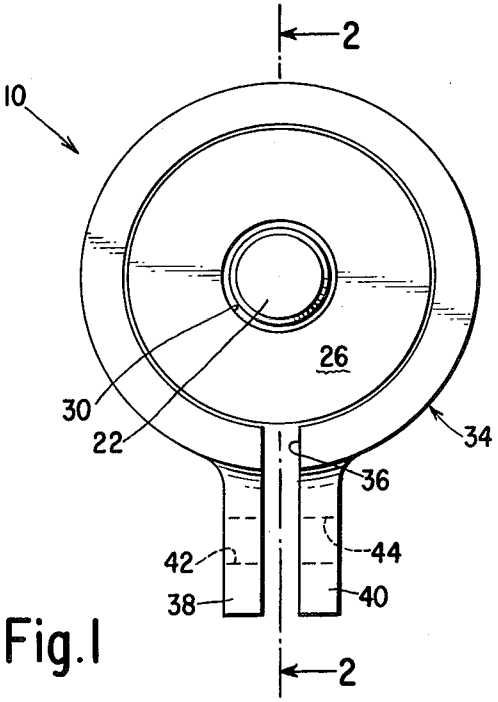
FIG. 1 is an end elevational view of a solenoid incorporating the present invention.

Referring to the drawing for a detailed description of the preferred embodiment of the invention, a solenoid assembly is generally referred to by the reference number 10. The solenoid assembly 10 includes a current-carrying coil 12. The coil 12 consists of electrically conducting wire 14 wrapped around a spool 16 formed of non-magnetic material, such as plastic. The spool 16 has a cylindrical throughbore 18 therein along its central axis.

Figure 4:
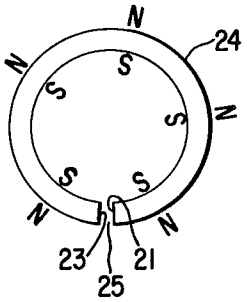
FIG. 4 is an end view of the flexible sheet deformed into a cylindrical shape for application to the armature core.
Figure 3:
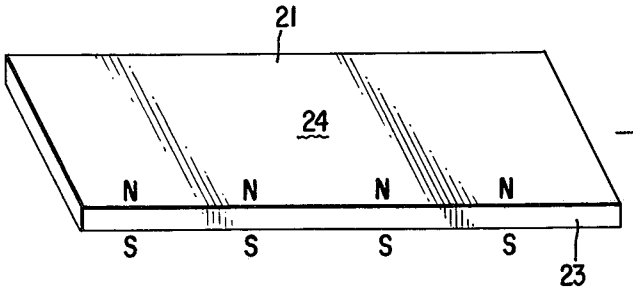
FIG. 3 is a perspective view of the flexible sheet in the flattened shape in which it is magnetized.

Slidably disposed within the throughbore 18 is an armature assembly 20. The armature assembly 20 includes a cylindrical core 22 formed of ferromagnetic material and a rectangular flexible sheet 24 which has been wrapped around the core 22 and attached thereto by any suitable means, such as epoxy cement or the like. The flexible sheet 24 has edges 21 and 23 which form a discontinuity 25 in the surface of the flexible sheet 24 when the flexible sheet 24 is wrapped around the core 22. The flexible sheet 24 is made of a magnetizable material, such as barium ferrite, which has been magnetized through its thickness while it occupies a flat substantially planar form as shown in FIG. 3. Although the magnetization of the sheet 24 need not be performed in a flat configuration, since the process for magnetizing the sheet 24 is the same as that for any metal magnet, and since bending of the sheet 24 into the configuration as shown in FIG. 4 has no adverse affect on its magnetism, the most convenient form would be a flat configuration. The length of the flexible sheet 24 must be less than the length of the coil 12 since the difference in these lengths will determine the travel of the armature assembly 20.

Situated at the ends of the coil 12 are a pair of anvils 26 and 28 made of non-magnetic material, which may also be plastic. These anvils 26 and 28 have circular apertures, 30 and 32 respectively, therethrough coaxial with the coil throughbore 18. The apertures 30 and 32 are of such a size as to allow passage of only the core 22 but not so large as to allow passage of that portion of the core 22 wrapped with the flexible sheet 24.

Surrounding the coil 12 and the anvils 26 and 28 is a cylindrical frame 34 made of ferromagnetic material. The frame 34 is formed having a split 36 along its length and two ears 38 and 40 located on opposite sides of the split 36 at one end of the frame 34 extending radially therefrom. These ears 38 and 40 have holes, 42 and 44 respectively, therein coaxial with each other. The split 36 is formed in the frame 34 such that when the two ears 38 and 40 are drawn together by fastening means, such as a screw (not shown), through the holes 42 and 44, the split 36 in the frame 34 will close causing the frame 34 to lock together the anvils 26 and 28 and the coil 12 as a unit.

In operation, when a DC potential is applied to the coil 12 of the solenoid assembly 10, the armature assembly 20 will move in one direction until the flexible sheet 24 reaches the end of the coil 12 and abuts one of the anvils 28 or 30. The armature assembly 20 will then remain in this position until a reverse DC potential is applied to the coil 12, whereupon the armature assembly 20 will move to the opposite end of the coil 12. The actual direction of movement of the armature assembly 20 is dependent on (1) the polarity of the DC potential as applied to the coil 12, (2) the direction in which the conducting wire 14 of the coil 12 is wrapped around the spool 16, and (3) which magnetic pole (north or south) of the flexible sheet 24 is facing the coil 12.

Having thus described the nature of the invention what we claim herein is:

1. A solenoid assembly which includes a current carrying coil having a throughbore therein and an armature assembly slidably disposed within said coil bore, wherein said armature assembly comprises:
   a. a core made of magnetic material; and
   b. a flexible sheet wrapped around and attached to a portion of said core within said coil bore, said flexible sheet being magnetizable material which has been permanently magnetized through its thickness.

2. A solenoid assembly as set forth in claim 1 wherein said flexible sheet is barium ferrite and when flattened is rectangular in shape.

3. A solenoid assembly as set forth in claim 1 which further comprises a pair of anvils made of non-magnetic material, said anvils disposed at opposite ends of said coil and attached thereto, said anvils having apertures therethrough coaxial with said coil bore and being of such a size as to only allow passage of that portion of said core not encompassed by said flexible sheet.

4. A solenoid assembly as set forth in claim 3 which further comprises a frame made of ferromagnetic material within which said coil and said anvils are mounted.

* * * * *